United States Patent [19]

Farris et al.

[11] Patent Number: 4,474,176

[45] Date of Patent: Oct. 2, 1984

[54] FOOT ARTICULATOR

[75] Inventors: Ray L. Farris, Holtville; Michael F. Rodi, San Diego; Ray L. Farris, Orange, all of Calif.

[73] Assignee: Joint Mobilizer Systems Corporation, San Diego, Calif.

[21] Appl. No.: 559,743

[22] Filed: Dec. 9, 1983

Related U.S. Application Data

[63] Continuation of Ser. No. 400,182, Jul. 26, 1982, abandoned, which is a continuation-in-part of Ser. No. 297,186, Aug. 28, 1981, abandoned.

[51] Int. Cl.[3] ..... A61H 1/02

[52] U.S. Cl. ..... 128/25 B

[58] Field of Search ..... 128/25 R, 25 B, 80 R, 128/80 G, 48–52; 272/73, 96

[56] References Cited

U.S. PATENT DOCUMENTS

| | | | |
|---|---|---|---|
| 3,318,304 | 5/1967 | Gurewich | 128/25 R |
| 3,580,244 | 5/1971 | Graves | 128/25 B |
| 3,976,057 | 8/1976 | Barclay | 128/25 R |

*Primary Examiner*—J. Yasko

*Attorney, Agent, or Firm*—Brown & Martin

[57] ABSTRACT

A portable device for articulating a person's foot relative to the person's lower leg. A first embodiment of the device includes a pair of opposing cast portions configured to conformably fit around the person's lower leg. A pair of frame members are each connected to one of the cast portions and extend below the lower ends of the cast portions. A foot support plate is pivotally connected to the lower ends of the frame members. Detachable straps are secured in surrounding relationship about the cast portions and frame members for holding the cast portions around the person's lower leg with the foot resting on the foot support plate. A motor mechanism and a connecting rod reciprocate the foot support plate and the foot carried thereby relative to the person's lower leg. A second embodiment has selectively extensible longitudinal frame members which are laterally adjustable relative to a leg surrounding U-shaped motor mount. A wishbone shape yoke has a pair of lower legs pivotally connected to opposite sides of a foot carrier. The upper leg of the yoke is connected to a crank driven by a motor.

20 Claims, 8 Drawing Figures

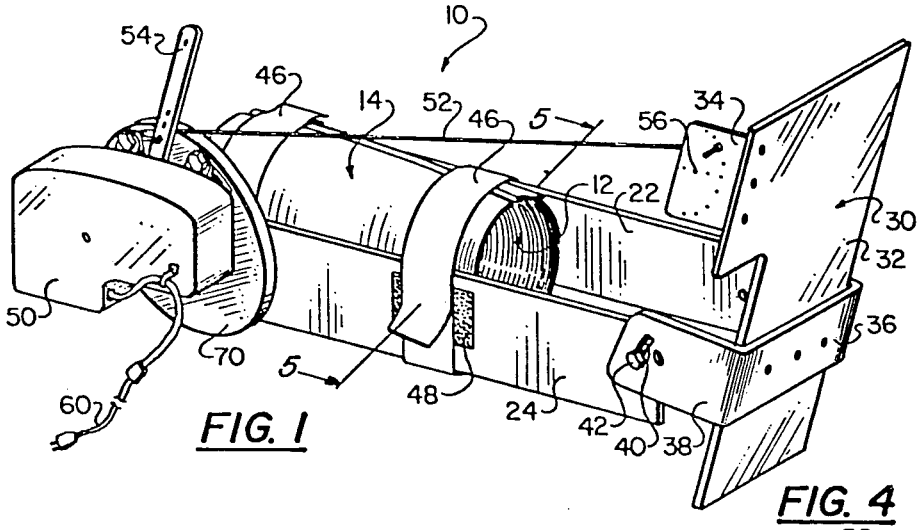
FIG. 1
FIG. 4
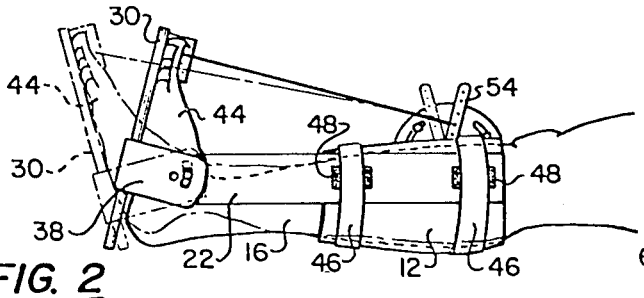
FIG. 2
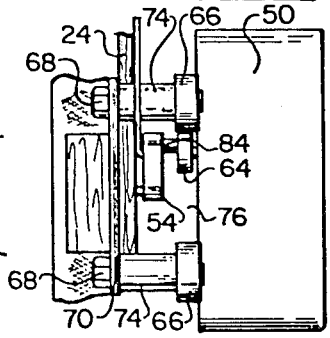
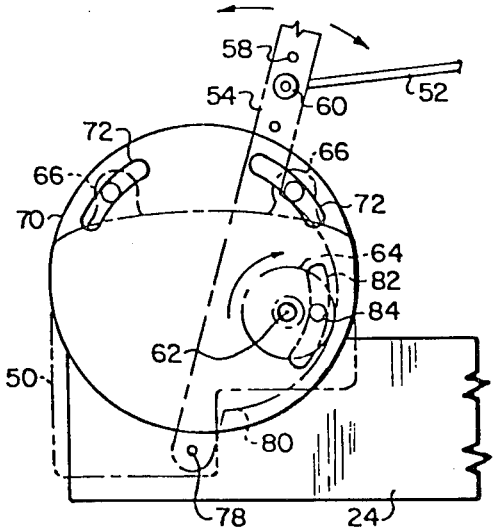
FIG. 3
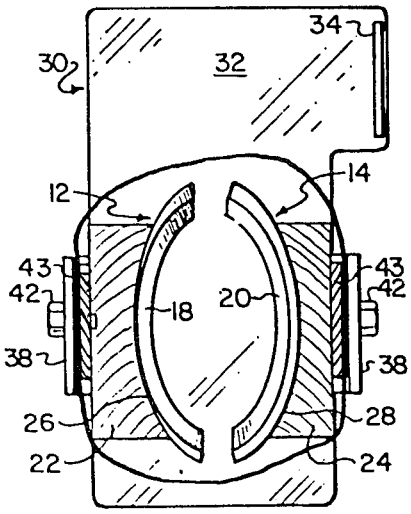
FIG. 5

FOOT ARTICULATOR

CROSS REFERENCE TO RELATED APPLICATION

This application is a continuation of application Ser. No. 400,182 filed Jul. 26, 1982 and now abandoned, which was a continuation-in-part of application Ser. No. 297,186 filed Aug. 28, 1981 and now abandoned.

BACKGROUND OF THE INVENTION

The present invention relates to physical therapy apparatus, and more particularly to a portable device for articulating a person's foot relative to the person's lower leg.

Therapeutic treatment of the human body may require motion to be induced in a specific part, for example, the ankle joint, for any of several reasons. Sickness, disease or injury may have caused a reduction in bodily functions, or may have left the patient unable to voluntarily move and exercise the muscles adjacent the joint. In some cases, a person can intentionally articulate a specific joint only if he or she can endure the resulting substantial pain.

It is well known that if there is no movement of a limb, the muscles therein will eventually atrophy. In some cases, muscle atrophy cannot be reversed by therapy and the atrophy seriously impedes use of the limb. Another problem with an immobilized limb is that the chances of a thrombosis occurring in the limb increase.

It is thus desirable to provide some mechanism for artificially inducing movement of a person's limb about a selected joint. One of the most complex joints which exist in any mammal is the human ankle joint which must be capable of sixty degree articulation under rather substantial loads. Many individuals suffer fractures of the ankle joint or experience traumatic injuries which result in bone chips in the ankle joint. These individuals must have their ankles encased in a cast for long periods of time. When the cast is removed, the muscles connected to the ankle joint, including the calf muscles, have usually undergone atrophy. In addition, there is usually an accompanying stiffness of the joint and surrounding tissues. Tenderness and a propensity for pain often make it uncomfortable for such a patient to articulate his or her own foot as part of a therapy program to restore muscle tone. Therefore, it would be desirable to have a compact, portable device which can be easily worn which artificially moves the foot relative to the ankle.

Heretofore, a number of apparatuses have been patented for articulating various portions of the human body, including the foot. U.S. Pat. No. 4,003,374 of Mizrachy discloses a device which may be used to move the foot of a patient who is anesthetized during surgery. An elongated frame which extends behind the leg has a strap at one end which surrounds the thigh of the patient and a hingedly mounted foot rest at its other end. A bellows positioned between the foot rest and a fixed vertical wall member is inflated and deflated through pneumatic circuitry not shown to move the patient's foot. Mizrachy also indicates that the foot rest can be moved by means of a motorized camming device, etc. Details of such mechanical drive mechanisms are not given.

U.S. Pat. No. 3,976,057 of Barclay discloses an apparatus for flexing the knee joint which includes a pair of straps which are wrapped around the calf and thigh, respectively. The straps are hingedly connected at the knee joint by mechanical linkages secured to the straps. These linkages are moved by pneumatic cylinders to articulate the knee. Somewhat similar to the device of Barclay is the device disclosed in U.S. Pat. No. 3,683,897 of Shield, et al.

U.S. Pat. No. 3,774,597 of Root discloses a device for artificially simulating the act of walking by holding a knee substantially stationary while sequentially elevating a heel of a foot associated with the knee, depressing the unsupported arch, and flexing the toes. U.S. Pat. No. 3,318,304 of Gurewich and U.S. Pat. No. 3,695,255 of Rodgers, et al. disclose mechanical devices which can be coupled to the foot of a hospital bed for simultaneously moving both of a patient's feet. U.S. Pat. No. 3,370,584 of Girtin discloses another device for simultaneously moving both of a person's feet. This device is mounted on a platform which appears to be supported on the floor but which could be supported on the mattress of a bed.

U.S. Pat. No. 3,323,518 of Swanson discloses a device for articulating a joint such as the elbow. It includes a cylinder or reciprocator whose ends are connected to straps which surround the forearm and bicep of a person's arm. The reciprocator includes a drive screw arrangement driven by a motor connected thereto by a flexible drive cable.

U.S. Pat. No. 3,917,261 of Small et al and U.S. Pat. No. 4,185,622 of Swanson disclose dual reciprocating foot rests. Finally, U.S. Pat. No. 3,742,940 of Phiffer discloses an oscillating foot rest which is reciprocable toward and away from a seat mounted on a base.

None of the patented devices discussed above provides a compact, portable device having a simple and reliable construction which may be comfortably fitted about the lower leg of a person for articulating his or her foot relative to the lower leg. In addition, none of the patented devices discussed above is readily adaptable for changing the stop and start points of the articulation as well as the total amount of articulation. Additionally, it would be desirable to have some mechanism in a foot articulating device that would better simulate the movement of a person's ankle joint than is provided in the patented devices above.

SUMMARY OF THE INVENTION

Accordingly, it is the primary object of the present invention to provide an improved device for artificially articulating a person's foot relative to the person's lower leg.

It is another object of the present invention to provide an apparatus of the aforementioned type in which the stop and start points of the articulation can be readily adjusted as well as the total amount of articulation.

Yet, another object of the present invention is to provide an apparatus of the aforementioned type which will better simulate and accommodate the movement of the person's ankle.

Another object of the present invention is to provide a device of the aforementioned type which can be readily installed and removed from a person's lower leg, and which will be comfortable when installed.

Still another object of the present invention is to provide a device of the aforementioned type which is compact and portable, yet which has a durable construction and reliable operating mechanisms.

Accordingly, the present invention provides an apparatus for articulating a person's foot relative to the person's lower leg. A first embodiment of the invention includes a pair of opposing cast portions. The cast portions are configured so that they conformably fit around the person's lower leg. A pair of frame members are each connected to one of the cast portions and extend below the lower ends of the cast portions. A foot support plate is pivotally connected to the lower ends of the frame members. The pivotal connection allows a sliding movement to accommodate the actual movement of the person's ankle joint.

In the first embodiment of the invention a detachable straps are secured in surrounding relationship about the cast portions and frame members for holding the cast portions around the person's lower leg with the foot resting on the foot support plate. A motor mechanism is mounted to the upper end of one of the frame members. A connecting rod is pivotally connected at one end to the foot support plate and at its other end by a crank connection to the drive shaft of the motor. When the motor is energized, the connecting rod reciprocates to move the foot support plate back and forth. The connection points of the rod may be changed to vary the amount of articulation. In addition, the structure which mounts the motor to the frame member allows the relative position of the crank mechanism to be adjusted, thereby permitting the stop and start points of the articulation of the foot support plate to be varied.

A second embodiment of the present invention has a pair of frame members which extend on each side of the lower leg, each frame member being selectively extensible. The upper ends of the frame members are removably connected to the sides of a U-shaped motor mount which surrounds the upper portion of the lower leg. Straps secure the motor mount to the lower leg.

In the second embodiment, a motor is mounted on the front of the U-shaped motor mount and drives a crank. The upper end of a wishbone-shaped yoke is pivotally connected to the crank. The two lower legs of the yoke are pivotally connected to opposite sides of the front end of a channel-shaped foot carrier. The rearward ends of the foot carrier sides are pivotally connected to the lower ends of the frame members.

BRIEF DESCRIPTION OF THE DRAWINGS

FIG. 1 is a perspective view of a first embodiment of my invention.

FIG. 2 illustrates the manner in which the first embodiment may be strapped about a person's lower leg for articulating the person's foot relative to his or her lower leg.

FIG. 3 is an enlarged, side elevation view of the motor mount and drive mechanism of the first embodiment.

FIG. 4 is an end elevation view of the motor, motor mount and drive mechanism of the first embodiment.

FIG. 5 is an enlarged sectional view of the first embodiment taken along line 5—5 of FIG. 1.

DESCRIPTION OF THE PREFERRED EMBODIMENTS

Figure 6:
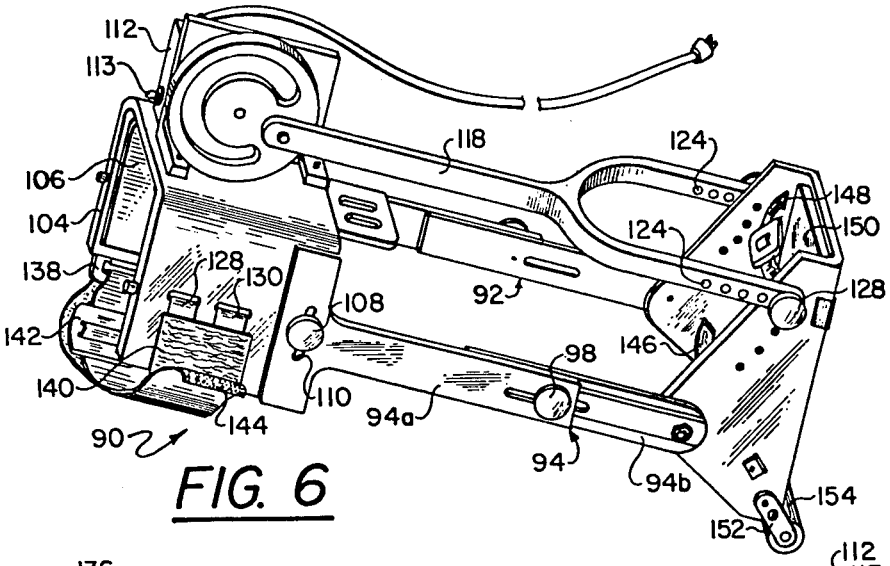
FIG. 6 is a perspective view of a second embodiment of my invention.

Referring to FIG. 1, there is illustrated a first embodiment 10 of my foot articulator. It includes a pair of left and right opposing cast portions 12 and 14. The cast portions are configured so that they conformably fit around a person's lower leg 16 (FIG. 2). The cast portions may be made of conventional materials utilized in the medical field by orthopedic surgeons. They may be fabricated by spreading the material around the lower leg of the person to be fitted with the apparatus to form a cast which completely encircles the lower leg. Thereafter, when the material sets, the entire cast may be cut in half into left and right portions 12 and 14. These portions have inner surfaces 18 and 20 (FIG. 5) which conformably fit around the lower leg 16 and permit the apparatus to be worn comfortably for long periods of time.

A pair of frame members 22 and 24 (FIG. 1) are secured to the outer surfaces 26 and 28 (FIG. 5) of corresponding ones of the frame members. These frame members extend from the upper ends of the cast portions to below the lower ends thereof. As shown in FIG. 5, the inner surfaces of the frame members are preferably curved to fit the outer curved surfaces of the cast portions. The outer surfaces of the frame members may be flat as seen in FIG. 1. The frame members may be made of wood, for example.

A foot support plate 30 (FIG. 1) is pivotally connected to the lower ends of the frame members 22 and 24. The foot support plate includes a L-shaped planar support member 32 having an orthogonally extending connecting plate 34 attached to the outer edge of its shorter leg. The foot support plate further includes a U-shaped yoke 36 whose intermediate segment is bolted to the other leg of the L-shaped support member 32 and whose legs 38 extend orthogonally from the support member on either side thereof. The legs 38 are spaced apart a suitable distance so that they can each overlap the lower end of a corresponding one of the frame members 22 and 24. The upper ends of the legs 38 of the yoke 36 have arcuate slots 40 formed therein. A connecting pin such as a bolt 42 extends through each of the arcuate recesses to pivotally connect each of the legs 38 to its corresponding frame member. Washers 43 fit over the bolts between the legs 38 of the yoke and the frame members. This type of pivotal connection allows both pivotal movement of the support plate relative to the frame members and forward and rearward (up and down in FIG. 1) movement of the axis of rotation of the foot support plate relative to the frame members and cast portions. Such sliding movement of the foot support plate accommodates the actual movement of the person's ankle joint.

FIG. 2 illustrates how the person's foot 44 is supported by the foot support plate 30 for articulation between the position shown in solid lines in FIG. 2 and the position shown in phantom lines in FIG. 2.

Fabric straps 46 (FIG. 1) surround the frame members and the cast portions adjacent the upper and lower ends of the cast portions for holding the apparatus in place around the lower leg 16 as shown in FIG. 2. Spacers 48 are affixed to the frame members and surrounded by the straps 46. The straps are each long enough so that they can surround the frame members and cast portions when the apparatus is fit around a person's leg and their ends will overlap. The ends are provided with a suitable means for attaching them together (not shown) such as snaps or mating hook-weave connecting surfaces such as the material sold under the trademark VELCRO. Thus, the straps can be readily detached to permit the cast portions to be pulled apart from around the lower leg 16. When the device is fit around a person's leg, the straps are quickly connected to hold the apparatus in place.

A motor mechanism 50 (FIG. 1) is mounted to the upper end of the frame member 24. A connecting rod 52 is pivotally connected at its lower end to the foot support plate and at its upper end to a crank 54 which is reciprocated back and forth by the motor mechanism. The connecting rod may be a long slender metal rod having its upper and lower ends bent at 90 degree angles with respect to its main portion. The lower end of the connecting rod is inserted through one of a plurality of holes 56 in the connecting plate 34. The upper end of the connecting rod is inserted through one of a plurality of longitudinally spaced holes 58 (FIG. 3) in the crank 54. The ends of the connecting rod are held in place by removable nuts 60. The ends of the connecting rod can be inserted through different ones of the holes 56 and 58 to vary the amount of articulation of the foot.

The structure which mounts the motor mechanism 50 to the frame member 24 allows the relative position of the crank to be adjusted, thereby permitting the stop and start points of the articulation of the foot support plate to be varied.

The motor mechanism 50 (FIG. 1) may comprise an AC motor and a reduction gear drive coupled thereto, both housed within a rectangular metal casing. Electric power may be supplied to the motor through a cord 60. The reduction drive has an output shaft 62 (FIG. 3) to which is connected an eccentric 64. In FIG. 3, the housing of the motor mechanism 50 is shown in phantom lines so that the eccentric 64 is visible. The motor mechanism has a pair of mounting flanges 66 having holes therethrough. Bolts 68 (FIG. 4) extend through the holes in the mounting flanges 66 to rigidly secure the motor mechanism 50 to a mounting disk 70 (FIGS. 1 and 3). The mounting disk 70 is secured to the upper end of the frame member 24. The bolts 66 extend through arcuate slots 72 (FIG. 3) formed in the outer periphery of the mounting disk 70. The mounting disk is secured to the upper end of the frame member 24 (FIG. 1). Cylindrical spacers 74 (FIG. 4) carried by the bolts 68 hold the motor mechanism 50 in spaced relationship from the mounting disk 70. The lower end of the crank 54 extends through the space 76 between the mounting disk and the motor mechanism and is pivotally connected to the frame member 24 by a pin 78 (FIG. 3).

The lower portion of the crank 54 (FIG. 3) has an enlarged portion 80 with an arcuate slot 82 formed in the periphery thereof. The pin 84 of the eccentric 64 is received in the arcuate slot 82 in the crank 54. Thus, rotation of the output shaft 62 by the motor contained within the motor mechanism 50 causes the upper end of the crank to reciprocate back and forth as indicated by the arrows in FIG. 3. This motion is transmitted by the connecting rod 52 to articulate the foot support 30 and the foot 44 carried thereby. Preferably, the rate of rotation of the output shaft 62 is very slow, for example three cycles per minute. One suitable motor mechanism 50 may be the type utilized in the ice-maker of a household refirgerator.

The bolts 68 may be loosened so that they can be slid laterally in the arcuate slots 72 in the mounting disk 70. Thereafter, the bolts are retightened to secure the motor mechanism 50 in a new angular orientation. This allows the stop and start points of the articulation of the foot support 30 to be adjusted.

Figure 7:
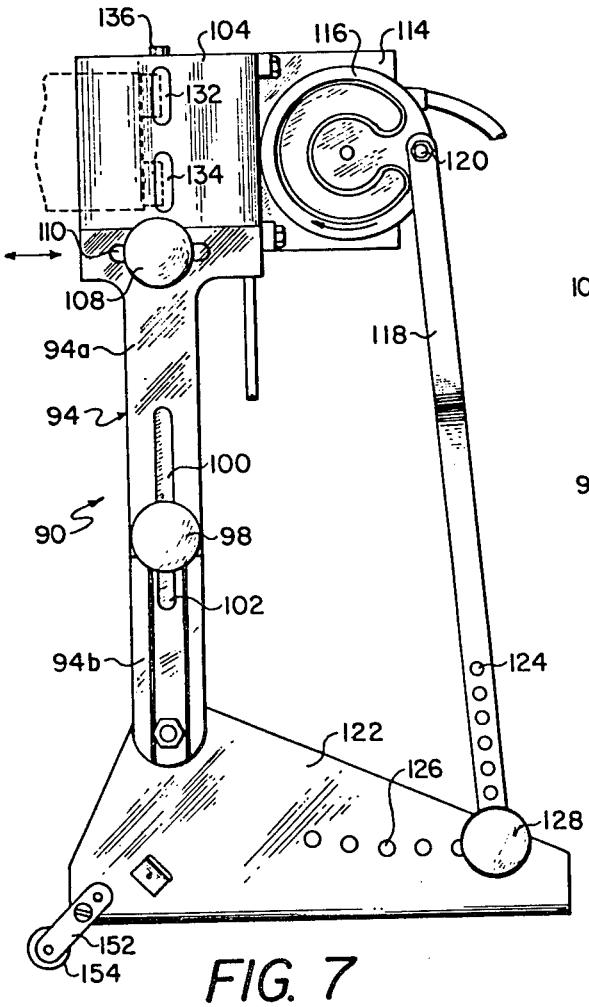
FIG. 7 is an enlarged side elevation view of the second embodiment.
Figure 8:
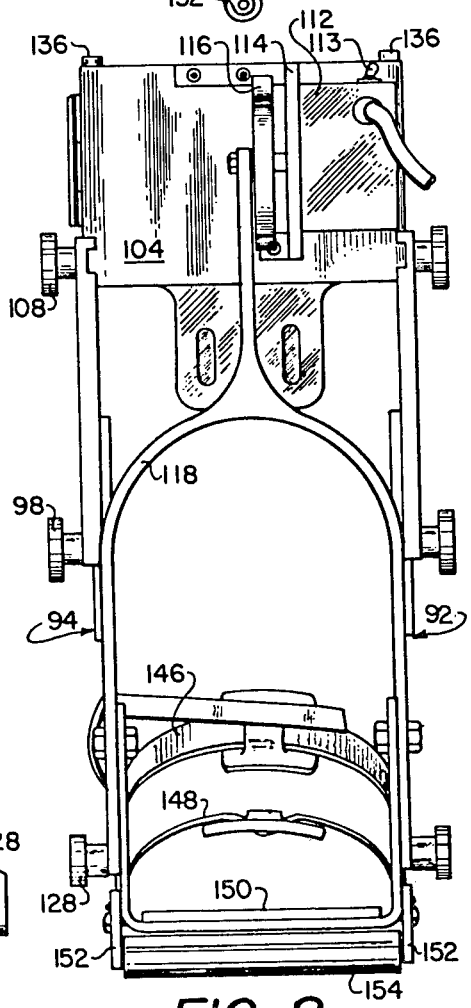
FIG. 8 is an enlarged front elevation view of the second embodiment with portions broken away.

A second embodiment 90 of my foot articulator is illustrated in FIGS. 6–8. It includes a pair of parallel extending frame members 92 and 94 spaced a sufficient distance apart so that they can extend on either side of the lower leg. Each of the frame members, such as 94, has an upper T-shaped portion **94*a* and a lower straight portion 94*b*. The frame members are selectively extensible by loosening a quick release nut 98 on a bolt which extends through aligned slots 100 and 102 (FIG. 7) in the portions 94*a* and 94*b*. Thus, the frame members 92 and 94** can be lengthened or shortened to accommodate lower legs of various lengths.

The upper ends of the T-shaped frame members portions, such as **94*a*, are removably connected to corresponding sides of a U-shaped motor mount 104 (FIG. 6). This motor mount surrounds the upper portion of the lower leg and has an internal foam pad lining 106 which serves as a cushion. The T-shaped frame member portions, such as 94*a*, are removably bolted to corresponding sides of the U-shaped motor mount with bolts secured by quick release nuts 108. The bolts extend through slots such as 110 and threadably engage the corresponding sides of the motor mount. The slots 110 permit lateral adjustment of the frame members 94 as indicated by the arrows in FIG. 7**. This permits the device to be configured to fit different sizes of legs, i.e. adults and children.

An electric motor 112 (FIG. 8) is mounted on the front of the U-shaped motor mount 104 via bracket 114. The motor 112 includes mechanisms for slowly rotating a crank 116 (FIG. 7). An on/off toggle switch 113 is provided in a convenient location on the motor 112. The upper end of a wishbone-shaped yoke 118 is pivotally connected to the eccentric 120 of the crank. The two lower legs of the yoke are pivotally connected to opposite sides of the front end of a channel-shaped foot carrier 122. The twin legs of the yoke 118 ensure that the foot carrier 122 will not twist during articulation. The rearward ends of the foot carrier sides are pivotally connected to the lower ends of the frame members 94. Thus, rotation of the crank 116 causes the yoke 118 to articulate the foot carrier 122.

The two lower legs of the yoke each have a series of holes 124 therethrough (FIG. 6). The sides of the foot carrier 122 each have a series of holes 126 (FIG. 7) therethrough. Each leg of the yoke is removably connected to the foot carrier by a bolt secured by a quick release nut 128. The bolts may be inserted through different ones of the holes 124 in the yoke and different ones of the holes 126 in the foot carrier. This permits the stop and start points of the articulation of the foot carrier to be readily adjusted. Also, it permits the total amount of articulation to be adjusted.

The second embodiment 90 of my foot articulator further includes strap means for securing the device to a persons lower leg and foot. Referring to FIG. 6, a pair of straps 128 and 130 are folded into loops which extend into corresponding slots 132 and 134 (FIG. 7) in each side of the U-shaped motor mount 104. Removable pins 136 extend vertically through the slots 132 and 134 and through the loops formed by the straps 128 and 130 to hold the same in place. The straps 128 and 130 are shown in phantom lines in FIG. 7. A large plastic buckle 138 (FIG. 6) is secured to the straps 128 and 130 on one side of the motor mount. A large strap 140 has one end sewn to the straps 128 and 130. This strap may be threaded through a foam pad 142, through the buckle 138 and then back over itself so that its free end 144 overlies the other end which is sewn to the straps 128 and 130. Preferably, the large strap 140 has mating hook-weave connecting surfaces on opposite ends thereof so that when the free end of the strap 144 is pressed against the other end of the strap, it will be securely attached.

When the second embodiment 90 is to be installed on a person's lower leg, the large strap 140 is undone, and the U-shaped motor mount 104 is slid over the upper part of the leg, near the knee, from the front of the leg. The large strap 140 is then secured as illustrated in FIG. 6 to hold the upper portion of the device firmly in place. The pads 106 and 142 ensure that the device has a comfortable fit.

A pair of similarly constructed strap assemblies 146 and 148 (FIGS. 6 and 8) are provided for securing the person's foot to the foot carrier 122. A foam pad 150 rests on top of the base portion of the foot carrier. A pair of brackets 152 (FIGS. 6 and 7) extend downwardly and rearwardly from the rear of the foot carrier 122 and rotatably support a cylindrical roller 154. When a person is sitting on a bed, with his or her legs extending horizontally, the second embodiment 90 may be strapped to the lower part of one leg. The foot is strapped within the foot carrier. Switch 113 may then be moved to start the motor 112. The foot carrier 122 then moves back and forth to articulate the ankle. The roller 154 permits the rearward end of the foot carrier 122 to roll back and forth on the top of the bed.

Having described two embodiments of my foot articulator, it should be apparent to those skilled in the art that my invention may be further modified in both arrangement and detail. For example, mechanisms could be added to the apparatus for permitting the speed of articulation to be adjusted. Therefore, the protection afforded my invention should be limited only in accordance with the scope of the following claims.

I claim:

1. An apparatus for articulating a person's foot relative to the person's lower leg, comprising:

means for supporting the foot;

a pair of longitudinally extending frame members having lower ends pivotally connected to opposite sides of the foot supporting means for extending along opposite sides of the lower leg;

means for securing the upper ends of the frame members to the lower leg;

a motor;

means for mounting the motor to the upper ends of the frame members; and means for drivingly connecting the motor and the foot supporting means to cause the foot supporting means to reciprocate back and forth relative to the frame members, the driving connection means including a wishbone-shaped yoke whose lower legs are pivotally connected to opposite sides of the foot supporting means.

2. An apparatus according to claim 1 and further comprising means for securing the foot to the foot supporting means.

3. An apparatus according to claim 1 wherein the means for securing the upper ends of the frame members to the lower leg includes a pair of opposing cast portions adapted to conformably fit around the person's lower leg.

4. An apparatus according to claim 1 wherein the frame members include means for permitting their lengths to be adjusted.

5. An apparatus according to claim 1 wherein the driving connection means includes means for permitting the stop and start points of the reciprocation of the foot supporting means to be adjusted.

6. An apparatus according to claim 1 wherein the driving connection means includes means for permitting the amount of reciprocation of the foot supporting means to be adjusted.

7. An apparatus according to claim 1 wherein the means for mounting the motor includes means for permitting lateral adjustment of the frame members.

8. An apparatus according to claim 1 wherein the driving connection means includes a crank.

9. An apparatus for articulating a person's foot relative to the person's lower leg, comprising:

a foot carrier having a pair of sides and a base, each side having a series of holes therethrough;

a U-shaped motor mount sized to surround the upper portion of the lower leg and having a front and two sides;

a pair of selectively extensible longitudinal frame members having lower ends pivotally connected to corresponding ones of the foot carrier sides;

means for connecting the upper ends of the frame members to corresponding ones of the motor mount sides to permit selective lateral adjustment of the frame members relative to the motor mount;

a motor mounted to the front of the motor mount;

a crank drivingly connected to the motor mount;

a yoke having an upper leg pivotally connected to the crank and a pair of lower legs, the lower legs each having a series of holes therethrough;

means for pivotally connecting the lower legs of the yoke to corresponding ones of the foot carrier sides and extending through preselected ones of the holes in the lower legs and in the foot carrier sides;

first strap means for securing the motor mount to the upper leg; and second strap means for securing the foot to the foot carrier.

10. An apparatus for articulating a person's foot relative to the person's lower leg, comprising:

a pair of opposing cast portions each having an upper end, a lower end, an outer surface and an inner surface adapted to conformably fit around the person's lower leg;

a pair of frame members each connected to the outer surface of one of the cast portions and having lower ends which extend below the lower ends of the cast portions;

a foot support plate;

means for pivotally connecting the foot support plate to the lower ends of the frame members;

detachable strap means for holding the cast portions around the person's lower leg;

a motor having a power shaft;

means for mounting the motor to the upper end of one of the frame members;

a connecting rod having a lower end pivotally connected to the foot support plate; and drive means coupling the power shaft of the motor to an upper end of the connecting rod so that when the motor is energized, the connecting rod will reciprocate to move the foot support plate back and forth.

11. An apparatus according to claim 10 wherein the foot support plate includes a planar support member and a U-shaped yoke connected to the planar support member having a pair of orthogonally extending legs spaced apart substantially the same distance as the spacing between the frame members, and further wherein the means for pivotally connecting the foot support plate to the lower ends of the frame members includes an arcuate slot in each of the legs, and a pair of bolts, each extending through one of the arcuate slots in a corresponding one of the legs and through the lower end of one of the frame members.

12. An apparatus according to claim 10 and further comprising means for permitting the stop and start points of the reciprocation of the foot support plate to be adjusted.

13. An apparatus according to claim 10 and further comprising means for permitting the amount of reciprocation of the foot support plate to be adjusted.

14. An apparatus according to claim 11 wherein the drive means includes an eccentric mounted on the power shaft, a crank pivotally connected to one of the frame members at its lower end and engaged with the eccentric for back and forth reciprocation upon rotation of the power shaft, and a rod connected between the upper end of the crank and the foot support plate.

15. An apparatus according to claim 10 wherein the detachable strap means includes a pair of straps surrounding the frame members and cast portions adjacent the upper and lower ends of the cast portions.

16. An apparatus according to claim 10 wherein the foot support plate includes a L-shaped planar support member having first and second legs, a connecting plate connected to the edge of one of the legs of the planar support member and extending orthogonally therefrom, and a U-shaped yoke having an intermediate segment extending across the other leg of the planar support member and a pair of spaced apart legs extending orthogonally from the planar support member and overlapping the lower ends of corresponding ones of the frame members.

17. An apparatus according to claim 16 wherein the connecting plate has a plurality of holes therethrough, and the drive means includes a connecting rod having a lower end adapted to be received in a selected one of the plurality of holes in the connecting plate.

18. An apparatus according to claim 10 wherein the drive means includes a crank reciprocated back and forth by the motor and having a plurality of longitudinally spaced holes therethrough and a connecting rod having an upper end adapted to be received in a selected one of the holes in the crank to thereby determine the amount of articulation of the foot support plate.

19. An apparatus according to claim 10 wherein each of the frame members has a curved inner surface adapted to conformably receive the outer surface of a corresponding one of the cast portions.

20. An apparatus for articulating a person's foot relative to the person's lower leg, comprising:

means for supporting the foot;

means for securing the foot to the foot supporting means;

a pair of longitudinally extensible frame members having lower ends pivotally connected to opposite sides of the foot supporting means for extending along opposite sides of the lower leg;

means for securing the upper ends of the frame members to the lower leg;

a motor;

means for mounting the motor to the upper ends of the frame members and for permitting lateral adjustment of the frame members; and means for both drivingly connecting the motor and the foot supporting means to cause the supporting means to reciprocate back and forth relative to the frame members; and means for permitting the amount of reciprocation of the foot supporting means to be adjusted.

* * * * *